US005163533A

United States Patent [19]

Lin

[11] Patent Number: 5,163,533

[45] Date of Patent: Nov. 17, 1992

[54] BRACE FASTENER FOR A FOLDING LADDER

[76] Inventor: Ching-Tsai Lin, No. 12 Alley 30, Lane 371, Hwacheng Road, Hsin Chuang City, Taipei Hsien, Taiwan

[21] Appl. No.: 753,350

[22] Filed: Aug. 30, 1991

Related U.S. Application Data

[63] Continuation-in-part of Ser. No. 611,053, Nov. 9, 1990, abandoned.

[51] Int. Cl.[5] ..... E06C 7/00

[52] U.S. Cl. ..... 182/176; 182/159

[58] Field of Search ..... 182/176, 161, 160, 159, 182/162

[56] References Cited

U.S. PATENT DOCUMENTS

| | | | |
|---|---|---|---|
| 2,670,120 | 2/1954 | Sanguineti | 182/160 |
| 2,727,671 | 12/1955 | Ollerhead | 182/160 |
| 3,084,760 | 4/1963 | Lamberti | 182/160 |
| 4,549,632 | 10/1985 | Inoue | 182/160 X |
| 4,815,564 | 3/1989 | Yoo | 182/160 |

FOREIGN PATENT DOCUMENTS

| | | | |
|---|---|---|---|
| 237767 | 1/1960 | Australia | 182/160 |
| 12954 | 2/1910 | Denmark | 182/160 |

*Primary Examiner*—Karen J. Chotkowski

*Attorney, Agent, or Firm*—Jacobson, Price, Holman & Stern

[57] ABSTRACT

A brace fastener for holding a step brace in position when the folding ladder in which said step brace is fastened is set up into shape, comprising a spring plate in an inverted T shape attached to either sidepiece of said folding ladder to hold a hook member in place and a control member movably hooked in said hook member for performing a second-order lever. Attaching said control member to the outer surface of the sidepiece of the folding ladder permits the hook member to be moved into a locking position to lock the step brace in position when the folding ladder is set up. Rotating the control member downwards causes the hook member to disconnect from the step brace so that the folding ladder can be collapsed.

3 Claims, 3 Drawing Sheets

FIG. 3A
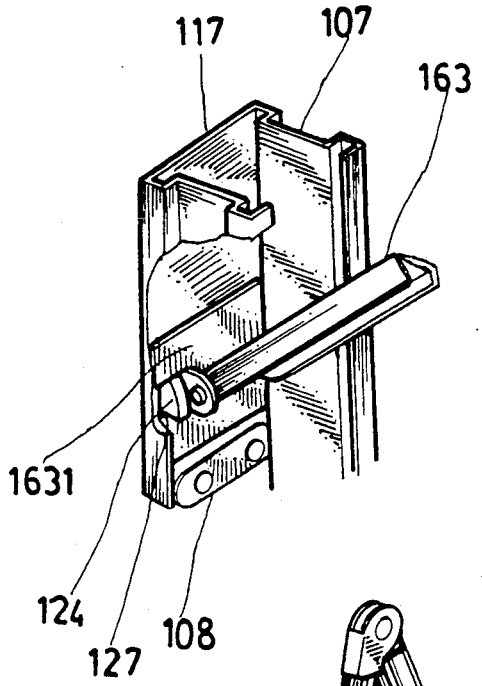
FIG. 3B
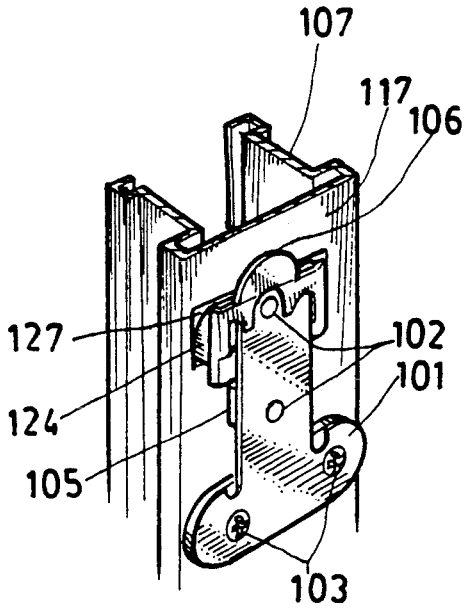
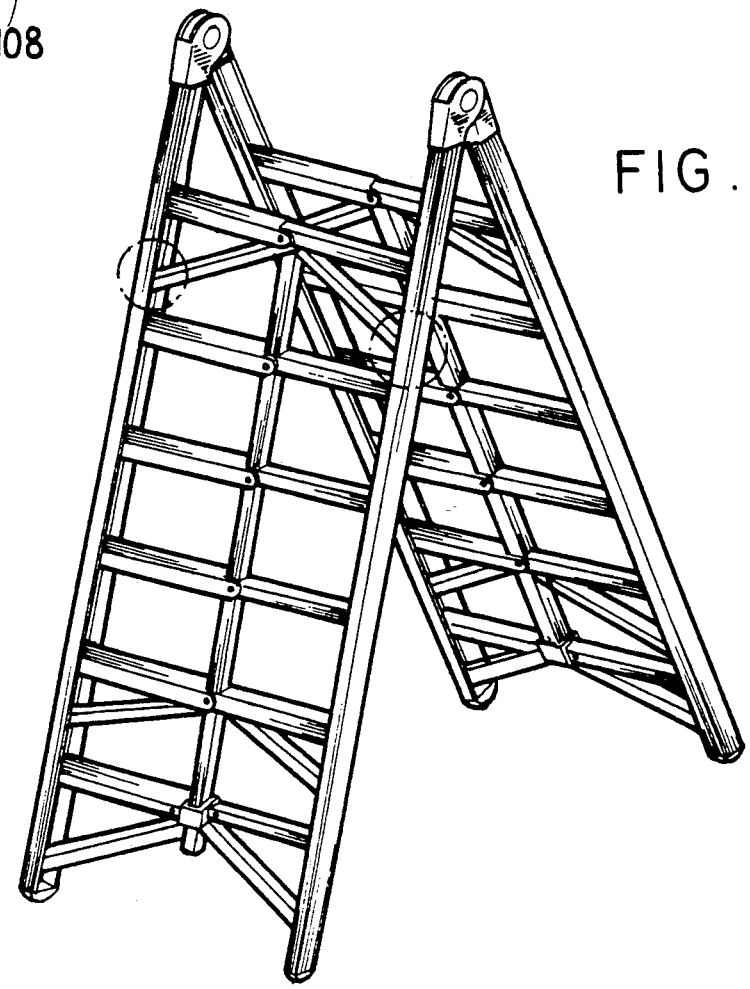
FIG. 3

BRACE FASTENER FOR A FOLDING LADDER

CROSS-REFERENCE TO RELATED APPLICATION

The present invention is a continuation in part of application Ser. No. 611,053 filed on Nov. 9, 1990 and now abandoned for "Folding ladder knock down in a bar shape".

BACKGROUND OF THE INVENTION

In U.S. Pat. application Ser. No. 611,053, there is disclosed a folding ladder which can be folded up into a bar shape to reduce space occupation when not in use. In this structure of folding ladders, movable braces are provided to support the rails and rounds in place when they are set up into shape. Because the braces are simply stopped by stop plates when they are extended to support the ladders into shape, they must be further secured by fastening means so as to ensure high stability.

The present invention has been accomplished to achieve this purpose. It is therefore the main object of the present invention to provide a brace fastener which can conveniently tightly fasten the movable braces of a folding ladder in place so as to provide an added stability to the folding ladder.

BRIEF DESCRIPTION OF THE DRAWINGS

FIG. 3 is an elevational view of a folding ladder in which the present invention is installed;

FIG. 3-A is a partly enlarged view taken on FIG. 3 showing that the slide block at the bottom of a step brace has been stopped by a stop plate and tightly secured in place by the hook member; and FIG. 3-B is a rear elevational view taken on FIG. 3-A.

DETAILED DESCRIPTION OF THE PREFERRED EMBODIMENT

Figure 1:
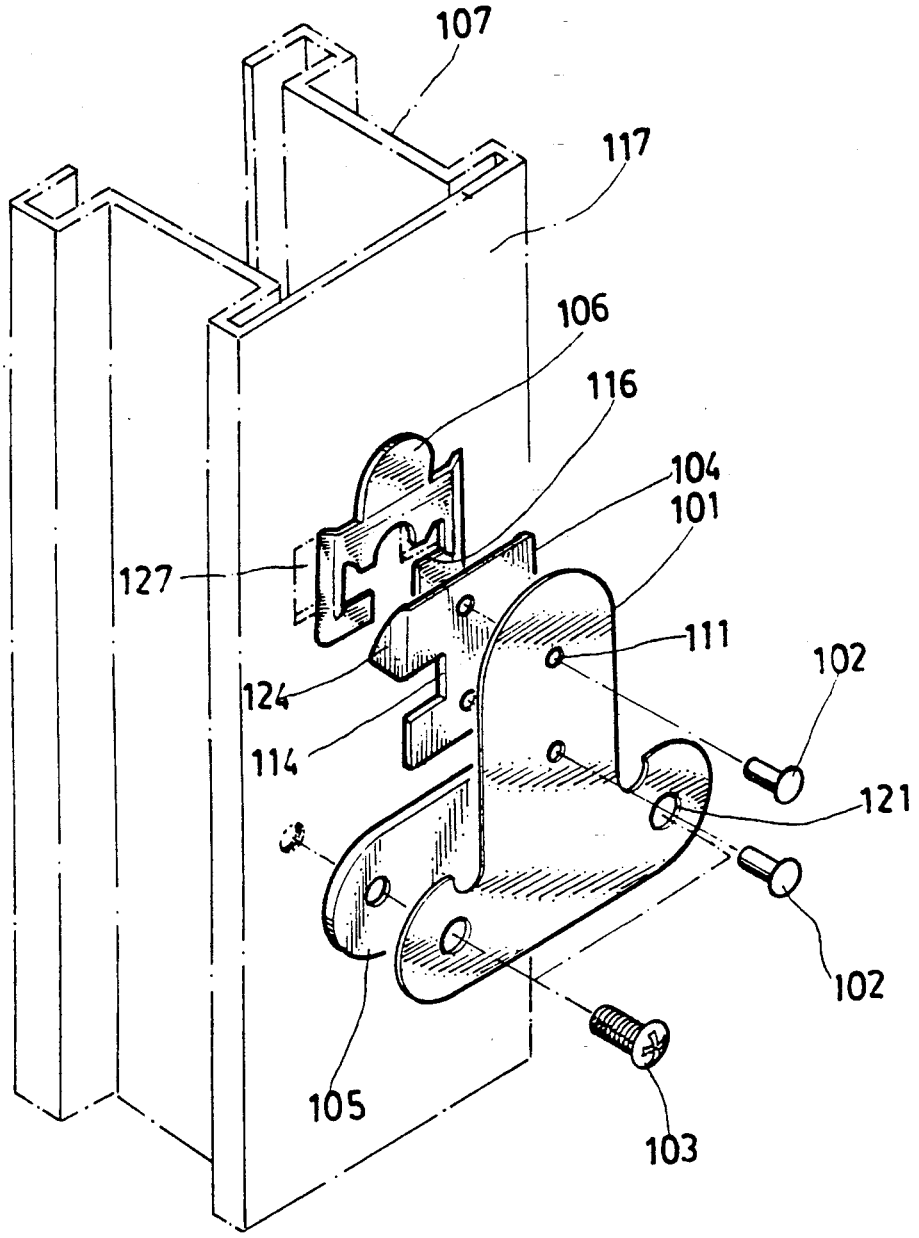
FIG. 1 is an exploded perspective view of the preferred embodiment of the brace fastener of the present invention.

Referring to FIG. 1, a brace fastener in accordance with the present invention is generally comprised of a spring plate 101 in a substantially inverted T shape having a plurality of holes 111, 121 made through punching process at proper locations for inserting rivets 102 or screws 103 to secure a hook member 104 and a cushion plate 105 thereto. The hook member 104 and the cushion plate 105 are respectively attached to the surface of the spring plate 101 on the same side with the cushion plate 105 disposed adjacent to the hook member 104 at the bottom. The hook member 104 is made in a substantially I-shaped structure, having a neck portion 114 at the middle and two hooked portions 124 bilaterally disposed at the top. There is also provided a control member 106 which has two projecting strips 116 bilaterally projecting inwards at the bottom and respectively hooked in the neck portion 114 of the hook member 104.

During installation, the cushion plate 105 and the spring plate 101 are attached to the flat outer wall 117 of either rail 107 at a suitable location by screws 103 permitting the two hooked portions 124 of the hook member 104 to project into an opening 127 on the flat outer wall 117 of the rail 107 for hooking up the sliding block 1631 of the adjacent step brace 163.

Figure 2:
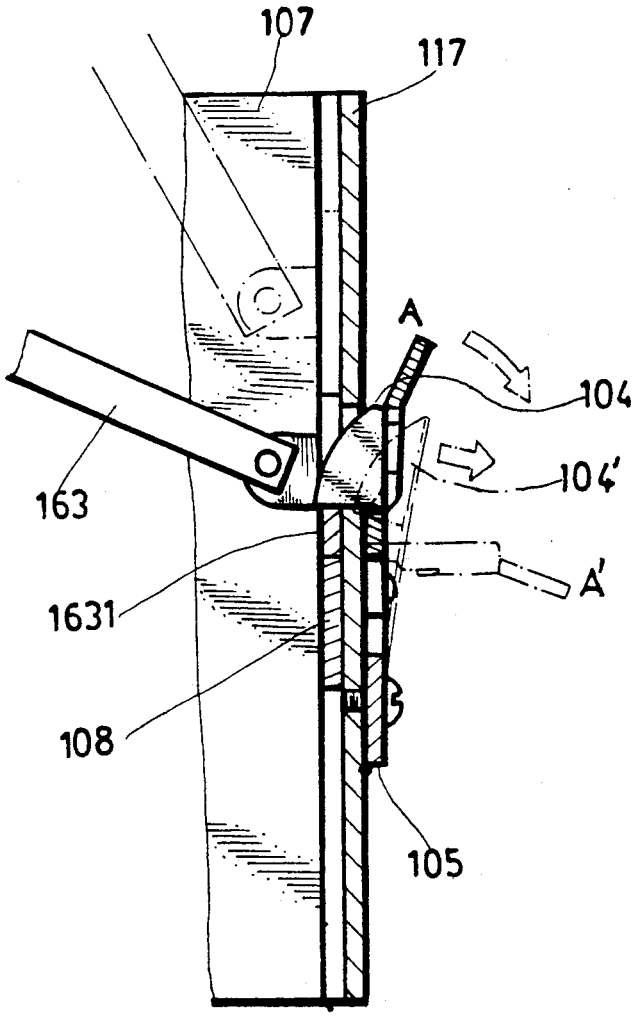
FIG. 2 is schematic drawing showing the operation of the brace fastener in clamping a step brace.

Referring to FIG. 2, the operation of the present invention is performed by using a second-order lever. As illustrated, bending the control member 106 from a vertical position "A" to a horizontal position "A'" causes the hook member 104 to incline backwards to a bevel position "104'", and therefore, the hooked portions 124 are disengaged from the sliding block 1631. Once the hooked portions 124 of the hook member 104 are disconnected from the sliding block 1631, the step brace 163 is released from constraint, and therefore, the folding ladder can be folded up into a bar-like structure.

Referring to FIG. 3, when the folding ladder is set up into shape, the sliding block 1631 of each step brace 163 is stopped at a stop plate 108 and simultaneously retained in place by the two hooked portions 124 of the hook member 104 which insert through the opening 127 (as shown in FIG. 3-A). By means of the aforesaid arrangement, the folding ladder provides added strength when it is set up into shape.

While the invention has been described by way of example, it is to be understood that the drawings are designed for purposes of illustration only, and various modifications could be made to the present invention without departing from the basic teachings thereof.

What is claimed is:

1. In a folding ladder of the type having movable step braces for supporting the steps thereof in place when the folding ladder is set up, for releasably securing each of said movable step brace a brace fastener comprising:

a spring plate in a substantially inverted T shape, said spring plate having a vertical portion extending upwards from a transverse portion at the middle, said transverse portion being secured to either sidepiece of said folding ladder at an outer side;

a hook member secured to said vertical portion by rivets, said hook member being made in a substantially I-shaped structure having a neck portion at the middle and two hooked portions bilaterally disposed at the top;

a cushion plate attached to said transverse portion and squeezed in between said spring plate and said sidepiece;

a control member movably secured to said hook member, said control member having two projecting strips bilaterally projecting inwards at the bottom and respectively hooked in said neck portion of said hook member; and wherein said two hooked portions of said hook member are inserted in an opening on said sidepiece to lock an adjacent step brace in position when said folding ladder is set up; said two hooked portions of said hook member are forced by said control member to disconnect from the adjacent step brace permitting said folding ladder to be collapsed.

2. The brace fastener of claim 1, wherein said control member is movably attached to said hook member and said hook member is fixedly attached to said spring plate respectively at such locations to form a second-order lever for controlling said two hooked portions of said hook member to retain the adjacent movable step brace or release therefrom.

3. The brace fastener of claim 1, wherein said control member has two projecting strips bilaterally projecting inwards at the bottom and respectively hooked in said neck portion of said hook member for performing a second-order lever to drive said two hooked portions of said hook member to disconnect from the adjacent movable step brace.

* * * * *